United States Patent [19]

Tamba et al.

[11] Patent Number: 4,890,584

[45] Date of Patent: Jan. 2, 1990

[54] ENGINE HAVING VERTICAL CRANKSHAFT

[75] Inventors: Shinichi Tamba, Kobe; Yoshiro Yamane, Akashi; Tetsuhiro Yamakawa, Kakogawa, all of Japan

[73] Assignee: Kawasaki Jukogyo Kabushiki Kaisha, Japan

[21] Appl. No.: 290,299

[22] Filed: Dec. 27, 1988

[30] Foreign Application Priority Data

Dec. 28, 1987 [JP] Japan ..... 62-201334[U]

[51] Int. Cl.[4] ..... F01P 1/02

[52] U.S. Cl. ..... 123/41.7; 123/41.66; 123/195 C

[58] Field of Search ..... 123/41.15, 41.66, 41.7, 123/195 C, 196 W, 198 E

[56] References Cited

U.S. PATENT DOCUMENTS 1,691,319 11/1928 Watkins ..... 123/41.66
3,183,899 5/1965 Tuggle ..... 123/41.7
4,432,309 2/1984 Hutchison et al. ..... 123/41.66
4,570,587 2/1986 Watanabe et al. ..... 123/193

FOREIGN PATENT DOCUMENTS 6057749 12/1982 Japan .

*Primary Examiner*—Noah P. Kamen
*Attorney, Agent, or Firm*—Leydig, Voit & Mayer

[57] ABSTRACT

An engine having a vertically disposed crankshaft includes an engine cover for closing a whole upper area of an engine body and having a skirt portion protruding downwardly from a periphery of the engine cover, and a cooling fan with a flywheel fixed to an output shaft of the engine below the engine body. The engine further includes a protruded shroud formed integrally on a wall portion of the engine body to completely close an annular clearance between the wall portion and the skirt portion, and a plurality of apertures formed in the protruded shroud to constitute a cooling air intake inlet.

3 Claims, 2 Drawing Sheets

ENGINE HAVING VERTICAL CRANKSHAFT

BACKGROUND OF THE INVENTION

The present invention relates to an engine having a vertically disposed crankshaft, that is used, for example, in lawn mowers and the like.

In a conventional engine having a vertically disposed crankshaft (a vertical crankshaft type engine), which is supported in cantilever fashion, as disclosed in the Japanese Utility Model Laid-Open No. 60-57749, a space between a dust guard cover and a crankcase is used as an intake opening or inlet for a cooling air.

However, in such a conventional vertical crankshaft type engine, since the air intake inlet is formed in a portion of the periphery of the engine, an area of the intake inlet is relatively small, and accordingly, there arises a problem that it is necessary to increase velocity of the cooling air flow in order to obtain a predetermined amount of the cooling air. Further, since the whole air intake inlet of wide cross-sectional area is opened to the atmosphere, there arises another problem that the cut lawn and/or dust are/is introduced into the interior of the engine body through the cooling air intake inlet, whereby the cut lawn and/or dust are/is adhered to fins of cylinders of the engine and are/is burnt thereon, or the cut lawn or the like is jammed in the air passage to worsen cooling ability.

SUMMARY OF THE INVENTION

In order to solve the above-mentioned problems, the present invention provides a vertical crankshaft type engine including an engine cover closing or covering the whole upper area of an engine body and having a skirt portion projecting downwardly from a periphery of the engine cover, and a cooling fan with a flywheel fixed to an output shaft of the engine below the engine body, wherein a protruded shroud is formed integrally with a wall portion of the engine body to completely cover an annular clearance between the wall portion and the skirt portion of the engine cover, and a plurality of apertures are formed in the protruded shroud to constitute a cooling air intake inlet.

DETAILED DESCRIPTION OF THE PREFERRED EMBODIMENTS

The present invention will now be explained in connection with a preferred embodiment thereof with reference to FIG. 1.

Figure 1:
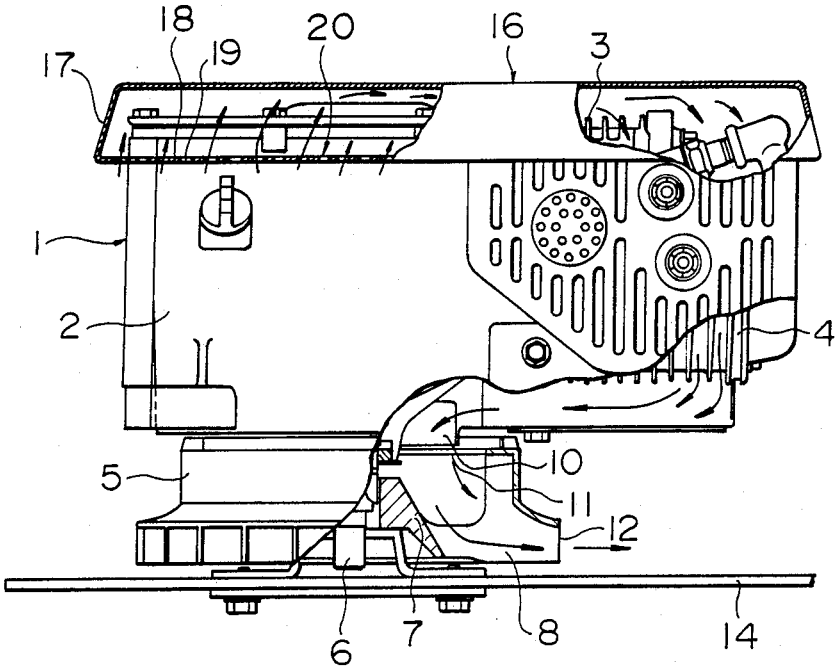
FIG. 1 is a front view showing, in partially broken, a vertical crankshaft type engine according to a preferred embodiment of the present invention.

Referring to FIG. 1 showing, in partially broken, an engine having a vertically disposed crankshaft according to a preferred embodiment of the present invention, cylinders 4 having a plurality of fins 3, a cantilevered crankshaft (not shown) and the like are accommodated within a crankcase 2 of an engine body 1. A flywheel 5 is disposed below the engine body 1, the flywheel 5 accommodating a boss 7 fixed on a lower portion of an output shaft 6 of the engine and a cooling fan 8 fixed to the boss 7. More particularly, the cooling fan 8 for creating or generating a cooling air flow for the engine is assembled in the flywheel 5, and accordingly, it can be said that the cooling fan 8 is a cooling fan with a flywheel. A cooling air passage 10 is formed in a bottom wall of the crankcase 2, an opening 11 opposed to the cooling air passage 10 is formed in a top wall of the flywheel 5, and a plurality of air discharge openings 12 are formed in and around a lower portion of a peripheral wall of the flywheel 5. The flywheel 5 is disposed above and attached to a cutter blade 14, and the crankcase 2 is disposed above and attached to the flywheel 5.

A whole upper area of the engine body 1 is closed or covered by an engine cover 16 which has a skirt portion 17 flared downwardly from a periphery of the engine cover 16. The skirt portion 17, in turn, covers a whole upper periphery of the crankcase 2. At the upper end of the crankcase 2, a shroud 18 is formed integrally on an upper peripheral wall of the crankcase and is protruded therefrom horizontally. A peripheral edge of the shroud 18 abuts against a lower end of the skirt portion 17. Thus, an annular clearance between the skirt portion 17 and the crankcase 2 is completely covered by the protruded shroud 18. A plurality of circular apertures 19 are formed in the protruded shroud 18, which apertures constitute a cooling air intake inlet 20.

In operation, by rotating the cooling fan 8, cooling air is introduced into the interior of the engine body 1 through the cooling air intake inlet 20, as shown by arrows in FIG. 1. The cooling air flows around the cylinders 4 disposed in the crankcase 2 to cool the cylinders 4, and then passes through the air passage 10 in the crankcase 2 and the opening 11 in the flywheel 5, and is finally discharged from the air discharge openings 12.

In this way, according to this embodiment, since the cooling air intake inlet 20 is provided around the whole peripheral area of the engine body 1, an area of the inlet 20 becomes large enough to introduce a required amount of the cooling air into the engine body, and thus, there is no need to increase the velocity of the cooling air flow for introducing the air into the engine, thereby reducing the possibility of the cut lawn and/or dust entering into the engine body. Further, since the cooling air flows into the engine body through the air intake inlet upwardly, the gravity of the cut lawn and/or dust can, in a certain extent, prevent the cut lawn and the like from entering into the engine body 1; this is particularly effective for heavy cut lawn and dust. In addition, since the air intake inlet 20 is constituted by the plurality of apertures 19 formed in the protruded shroud 18 in a manner to form a screen or filter, the penetration of the cut lawn and/or dust into the engine body 1 can also be positively prevented. Therefore, in the vertical crankshaft type engine according to this embodiment of the present invention, the penetration or entering of the cut lawn and/or dust into the engine body 1 can be effectively prevented, thereby completely eliminating the drawbacks that the cut lawn and/or dust is adhered to the fins 3 of the cylinders 4 and is burnt thereon, and that the cooling ability is worsened by the fact that the cut lawn and/or dust is jammed in the air passage. Further, since the cooling air is introduced into the engine body through the cooling air intake inlet 20 formed around the whole periphery of the crankcase 2, the crankcase 2 also can be cooled by such cooling air. In addition, since the protruded shroud 18 formed with the air intake inlet 20 is integrally formed on the crankcase 2, an assembling operation for attaching the shroud to the crankcase can be omitted, and thus, the engine can be obtained cheaply.

Next, the present invention will be explained in connection with another embodiment of the invention.

Figure 2:
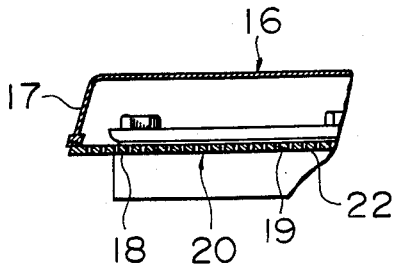
FIG. 2 is a vertical sectional front view showing a portion of a vertical crankshaft type engine according to another embodiment of the present invention.
Figure 3:
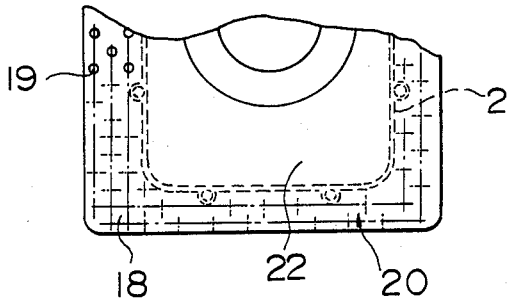
FIG. 3 is a plan view showing a portion of a lid of the vertical crankshaft type engine of FIG. 2.

In the afore-mentioned embodiment, the protruded shroud 18 is formed integrally on the crankcase 2 and protruded therefrom. However, in this another embodiment showing a cantilevered engine, since a lid 22 for closing an upper opening of a crankcase is formed by working or processing a sheet metal, as shown in FIGS. 2 and 3, a protruded shroud 18 is integrally formed around a periphery of the sheet metal lid 22 to extend therefrom outwardly as shown in FIGS. 2 and 3, and a plurality of circular apertures 19 are formed in the shroud 18 to constitute the cooling air intake inlet 20.

In the above-described embodiments, the apertures 19 are circular ones. However, the apertures 19 are not limited to such circular apertures, but may be of suitably selected configurations such as rectangular apertures, apertures in louvers and the like. Further, a dimension of each aperture 19, and a pitch between the apertures can be appropriately selected according to design requirements.

In addition, although embodiments of the present invention applied to the cantilevered engine was explained, it should be noted that the present invention can be applied to an engine supported at both sides thereof.

As mentioned above, according to the present invention, since the cooling air intake inlet is provided around the whole peripheral area of the engine body and the air intake inlet is constituted by a plurality of apertures formed in the protruded shroud, and since the cooling air passes through the intake inlet upwardly, the penetration or entry of the cut lawn and/or dust into the engine body can be effectively prevented, and particularly, the penetration of the heavy and/or large cut lawn and/or dust into the engine body can completely prevented, thereby completely eliminating the drawbacks that the cut lawn and/or dust are/is adhered to the fins of the cylinders and are/is burnt thereon and that the cooling ability is worsened by the jamming of the air passage due to the cut lawn and/or dust. Further, since the cooling air is introduced through the air intake inlet formed around the whole periphery of the crankcase, the crankcase also may be cooled by such cooling air. In addition, since the protruded shroud is integrally formed on the wall portion of the engine body, there is almost no increase in cost and in assembling operations for providing the protruded shroud, thus obtaining the improved engine cheaply.

What is claimed is:

1. An engine having a vertically disposed crankshaft, including an engine cover for closing a whole upper area of an engine body and having a skirt portion protruding downwardly from a periphery of said engine cover, and a cooling fan with a flywheel fixed to an output shaft of the engine below said engine body, wherein:

a protruded shroud is formed integrally on a wall portion of said engine body to completely close an annular clearance between said wall portion and said skirt portion of said engine cover; and a plurality of apertures are formed in said protruded shroud to constitute a cooling air intake inlet.

2. An engine having a vertically disposed crankshaft according to claim 1, wherein said wall portion of the engine body on which said protruded shroud is formed is a side wall of a crankcase.

3. An engine having a vertically disposed crankshaft according to claim 1, wherein said wall portion of the engine body on which said protruded shroud is formed is a sheet metal lid for closing a crank chamber of a crankcase.

* * * * *